US009267280B2

(12) United States Patent
Sawatzky et al.

(10) Patent No.: US 9,267,280 B2
(45) Date of Patent: Feb. 23, 2016

(54) STRUCTURAL PANELS, CLADDING ASSEMBLIES AND COMPONENTS

(71) Applicants: John Sawatzky, Abbotsford (CA); Herman Sawatzky, Abbotsford (CA); Mike Henry, Seattle, WA (US)

(72) Inventors: John Sawatzky, Abbotsford (CA); Herman Sawatzky, Abbotsford (CA); Mike Henry, Seattle, WA (US)

(73) Assignee: VIREO LLC, Eagle, OH (US)

( * ) Notice: Subject to any disclaimer, the term of this patent is extended or adjusted under 35 U.S.C. 154(b) by 0 days.

(21) Appl. No.: 14/378,634

(22) PCT Filed: Feb. 14, 2013

(86) PCT No.: PCT/US2013/026214

§ 371 (c)(1),
(2) Date: Aug. 13, 2014

(87) PCT Pub. No.: WO2013/123250

PCT Pub. Date: Aug. 22, 2013

(65) Prior Publication Data

US 2015/0013258 A1 Jan. 15, 2015

Related U.S. Application Data

(60) Provisional application No. 61/598,825, filed on Feb. 14, 2012, provisional application No. 61/725,943, filed on Nov. 13, 2012.

(51) Int. Cl.
*E04B 1/70* (2006.01)
*E04B 2/46* (2006.01)
(Continued)

(52) U.S. Cl.
CPC ..... *E04B 1/7038* (2013.01); *E04B 2/46* (2013.01); *E04C 2/22* (2013.01); *E04C 2/38* (2013.01); *E04C 2/521* (2013.01); *E04F 13/0889* (2013.01); *E04F 13/09* (2013.01)

(58) Field of Classification Search
CPC ..... E04B 2/42–2/48; E04B 1/7604; E04B 1/7612; E04B 1/703; E04B 1/7038; E04C 1/41; E04C 2/284; E04F 13/09; E04F 13/0889; E04F 13/0862
USPC ..... 52/302.1, 302.3, 309.1, 407.4, 407.5, 52/407.1
See application file for complete search history.

(56) References Cited

U.S. PATENT DOCUMENTS 2,284,229 A * 5/1942 Palmer ..... E04C 2/292 52/407.1
3,214,876 A * 11/1965 Mattes ..... E04F 13/0864 52/407.1

(Continued)

OTHER PUBLICATIONS

Vireo LLC., "International Search Report and Written Opinion," Int'l Patent Application No. PCT/US2013/026214, filed Feb. 14, 2013 (May 6, 2013).

*Primary Examiner* — Brian Glessner
*Assistant Examiner* — Adam Barlow
(74) *Attorney, Agent, or Firm* — Seed IP Law Group PLLC

(57) ABSTRACT

Structural panels, components and assemblies are described. The structural panel system comprises one or more panels having interlocking profile features providing convenient assembly of multiple panels to provide pre-assembled panels or structures, or components that are easily shipped and assembled at a site to satisfy a variety of building requirements, transport requirements, structural panel requirements, and the like. An integrated raceway gutter system may be provided for evacuation of moisture in conjunction with end-caps having a coordinating structure. Insulation components may be positioned at an interior side of panels and may be separated from the capillary break by a moisture impervious and/or heat reflective layer. Cladding panels may be pre-assembled, along with additional structural building components, to provide pre-assembled structural insulative (and non-insulative) panels. Additional system components, including end caps, a sill, a head, a façade, a jamb and accessory brackets, are also described.

18 Claims, 20 Drawing Sheets

(51) Int. Cl.

| | |
|---|---|
| ***E04C 2/22*** | (2006.01) |
| ***E04C 2/38*** | (2006.01) |
| ***E04C 2/52*** | (2006.01) |
| ***E04F 13/08*** | (2006.01) |
| ***E04F 13/09*** | (2006.01) |

(56) References Cited

U.S. PATENT DOCUMENTS 3,921,346 A * 11/1975 Sauer ..... E04B 2/7411 52/236.7
4,130,975 A * 12/1978 Kelley ..... E04C 2/292 52/546
4,320,613 A * 3/1982 Kaufman ..... E04F 13/0864 52/302.1
4,327,528 A * 5/1982 Fritz ..... E04B 1/7612 52/309.1
4,557,091 A 12/1985 Auer
5,016,415 A * 5/1991 Kellis ..... E04F 13/18 52/522
6,279,287 B1 8/2001 Meadows
6,823,633 B2 11/2004 Ryan
7,654,050 B2 * 2/2010 Justice ..... E04F 13/0864 52/276
7,823,333 B2 * 11/2010 Kim ..... A47F 5/0846 52/36.5
8,091,313 B2 * 1/2012 Wilson ..... E04F 13/007 52/302.1
8,555,582 B2 * 10/2013 Mollinger ..... E04F 13/0864 428/159
8,769,894 B2 * 7/2014 Power ..... E04B 1/70 52/302.1
2006/0000170 A1 * 1/2006 Pringle ..... E04F 13/0864 52/302.1
2010/0175341 A1 7/2010 Gilbert et al.
2010/0281801 A1 * 11/2010 Shaw ..... B32B 5/18 52/302.1

* cited by examiner

STRUCTURAL PANELS, CLADDING ASSEMBLIES AND COMPONENTS

REFERENCE TO RELATED APPLICATIONS

This application is a US national phase entry of International Patent Application No. PCT/US2013/026214, filed Feb. 14, 2013, which claims priority to U.S. Provisional Patent Application Nos. 61/598,825 Filed Feb. 14, 2012 and 61/725,943 filed Nov. 13, 2012. The priority patent applications are incorporated herein by reference in their entireties.

TECHNICAL FIELD OF THE INVENTION

The present invention relates to structural panels, cladding assemblies and components for use in construction, transport, and a variety of other applications. In some aspects, the present invention relates to modular panels having an internal cavity that may be filled with an insulative material to provide thermally and acoustically insulated structural panels for use in a variety of applications.

BACKGROUND OF THE INVENTION

Rainscreen cladding generally refers to a construction façade rainscreen system which consists of the subframe assembly in combination with different finishes, such as cladding panels, brick, ceramic tiles, reconstituted stone boards, ceramic granite based on a natural stone, high-pressure laminates, composite aluminum panels, metal panels (aluminum, zinc, steel), fiber-cement board, or durable exterior woods. An outer skin of rear-ventilated cladding is typically mounted to a new or existing building subframe. Rainscreen cladding systems typically employ a double-wall construction technique that includes an outer layer to keep out the rain and an inner layer to provide thermal insulation, prevent excessive air leakage and carry wind loading. The outer layer is preferably breathable, while the inner layer is constructed to reduce energy losses. When successfully designed and installed, the structural frame of the building remains dry, as water never reaches it or the thermal insulation. Water that migrates to the cavity between the outer and inner layer is typically eliminated by evaporation and drainage. Water droplets typically do not penetrate the panel joints or openings because wind pressure acting on the outer face of the panel is generally equalized in the cavity, so that there is no significant pressure differential to drive the rain through joints. During extreme weather, a minimal amount of water may penetrate the outer cladding. This, however, typically forms droplets that run down the back of the cladding sheets and are dissipated through evaporation and drainage. Using this type of system, the structural wall is insulated externally.

SUMMARY

The present invention relates to novel improvements in structural panels, cladding assemblies and components such as end-caps, sills, jambs, heads, brackets and the like, and assemblies comprising panels in combination with other components. Components and assemblies are suitable for use, for example, as cladding, structural panels, structural insulated panels, roofing, flooring, ceilings, barriers, retaining structures and the like, in construction applications, in transport applications, and in a variety of other applications. In some aspects, the present invention relates to panels and components that may be assembled to provide modular panels having an internal cavity that may be partially or entirely filled with an insulative material to provide insulated structural panels that may be manufactured, and used, as modular components. Assemblies and components described herein exhibit improved structural and insulative properties.

A pressure equalizing exterior cladding system composed of multiple coordinated components is described. The cladding system comprises one or more cladding façade components, or panels, and one or more coordinated end-caps. The cladding façade panels have a multi-layer construction incorporating multiple components having different profiles and functions. Cladding façade components interface with one another and can be easily and conveniently assembled to provide exterior cladding to satisfy a variety of building requirements. The cladding system comprises an exterior cladding layer or façade having a generally moisture impervious outer surface, a capillary break positioned behind the exterior cladding layer between the exterior cladding layer and an insulation component, and an integrated raceway gutter system provided between interlocking panels to provide for evacuation of any water and moisture that penetrates seams provided between adjacent interlocking panels or is diverted from elsewhere. Backwardly extending ribs may be provided extending on an interior side from the exterior cladding layer. The ribs may be attached or mounted or otherwise associated with insulation, with a capillary break provided between the exterior cladding layer and the insulation. A moisture impervious and/or heat reflective layer may be provided between the insulation layer and the capillary break. End-caps are designed to interface with end of the cladding façade panels to divert and carry away any liquid that penetrates the façade.

BRIEF DESCRIPTION OF THE FIGURES

FIG. 4A is a rendering showing an end-cap mounted to a façade panel of the present invention with the exterior wall of the end-cap removed to illustrate an exemplary internal configuration of the end-cap; FIG. 4B is a rendering showing an internal surface of an exemplary end-cap configured for mounting to a façade panel of the present invention; FIG. 4C is a rendering showing an enlarged top perspective view of a portion of a façade panel with an end-cap mounted to it; and FIG. 4D is an exterior, top perspective view of a façade panel and end-cap combination of the present invention.

FIG. 5 also illustrates a wall façade assembly that may be assembled at a building site or pre-assembled in wall panel units having various dimensions.

FIGS. 8A and 8B show a side, partially cross-sectional, view of the cladding panel and a side view of the cladding material, brackets and interlocking profiles, respectively. FIGS. 8C and 8D show renderings from exterior and interior side perspectives, respectively, illustrating two cladding façade panels of this embodiment assembled and interlocked with one another, with the insulation component of the upper panel removed for purposes of clarity.

DETAILED DESCRIPTION

Figure 1:
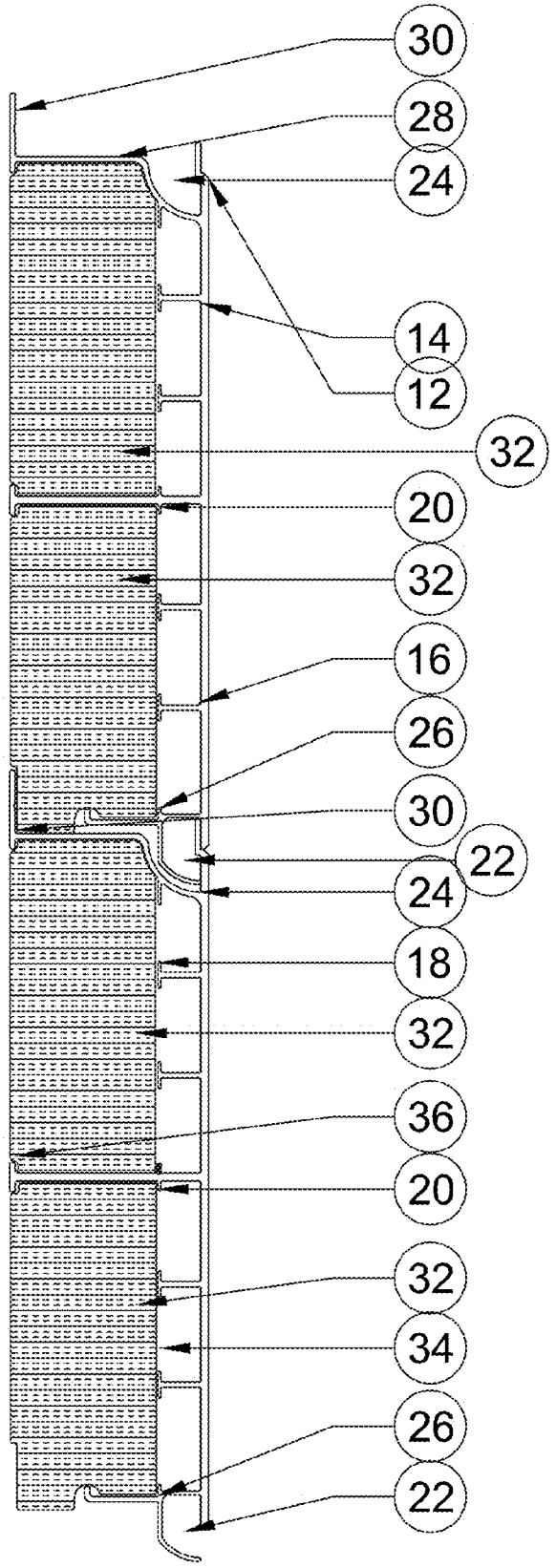
FIG. 1 shows a drawing illustrating one embodiment of two exterior cladding façade panels of the present invention interfaced with and mounted to one another.
Figure 2A:
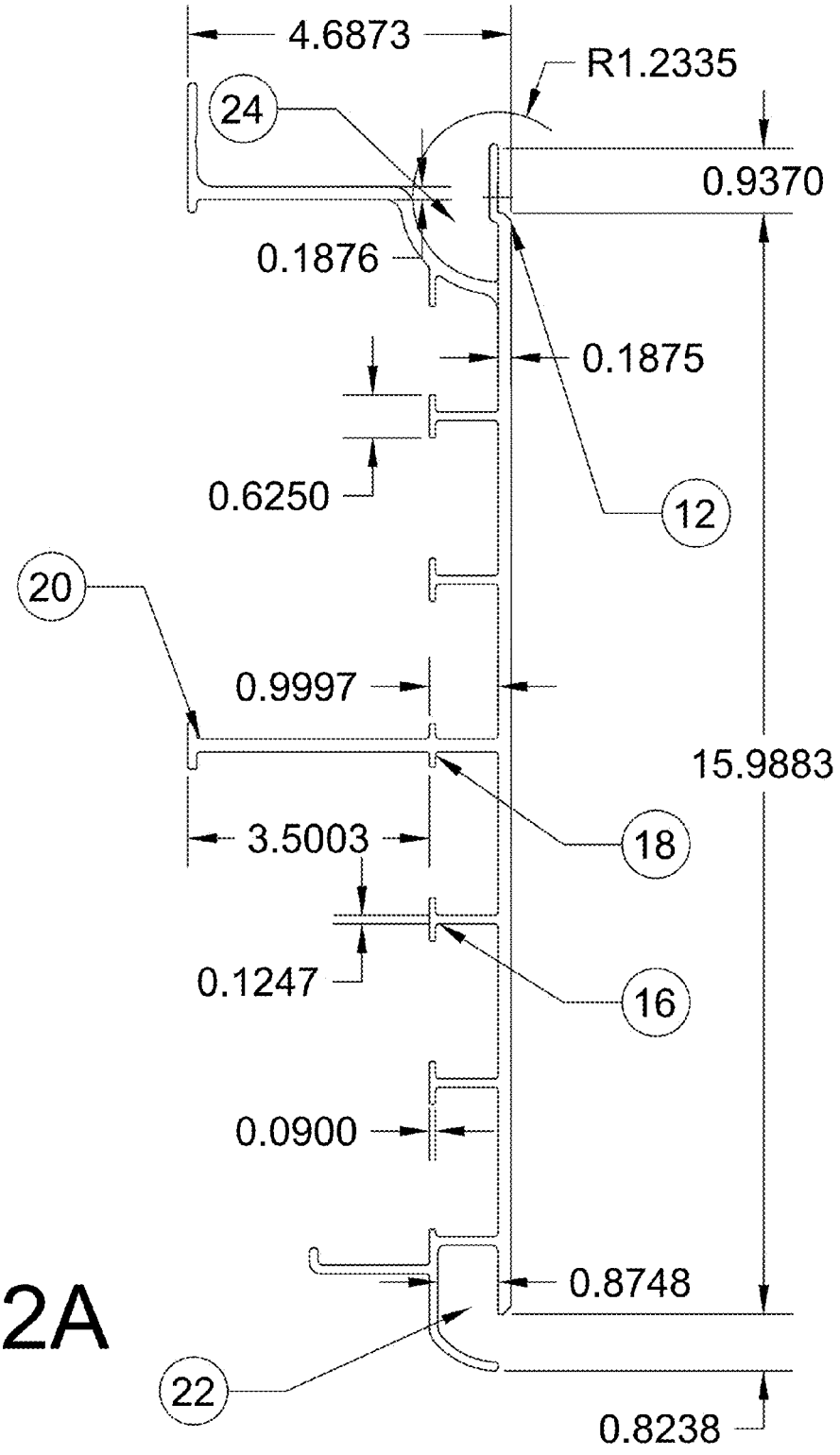
FIG. 2A shows a drawing illustrating a specific embodiment of an exterior cladding façade panel of the present invention similar to that shown in FIG. 1, with the insulation components removed. Exemplary dimensions are provided on this drawing.

FIG. 1 illustrates one embodiment of two exterior cladding panels of the present invention interlocked with one another and FIG. 2A shows an integral structural façade panel as illustrated in FIG. 1 with the insulation component removed. While FIG. 2A shows dimensional information for one embodiment of an integral structural façade component, it will be appreciated that these dimensions may be varied considerably without departing from the invention. The exterior cladding panels 10, in this embodiment, are composed of an exterior cladding layer 12 having an external surface 14 and a plurality of backwardly extending ribs 16. In the illustrated embodiment, ribs 16 are integral with the exterior façade and terminate in stops 18. Each exterior cladding panel 10 may (optionally) have one or more extended ribs 20 extending backwardly further than other ribs. Extending ribs 20 may provide support and facilitate positioning of insulation components, and may perform other functions as well.

Figure 2B:
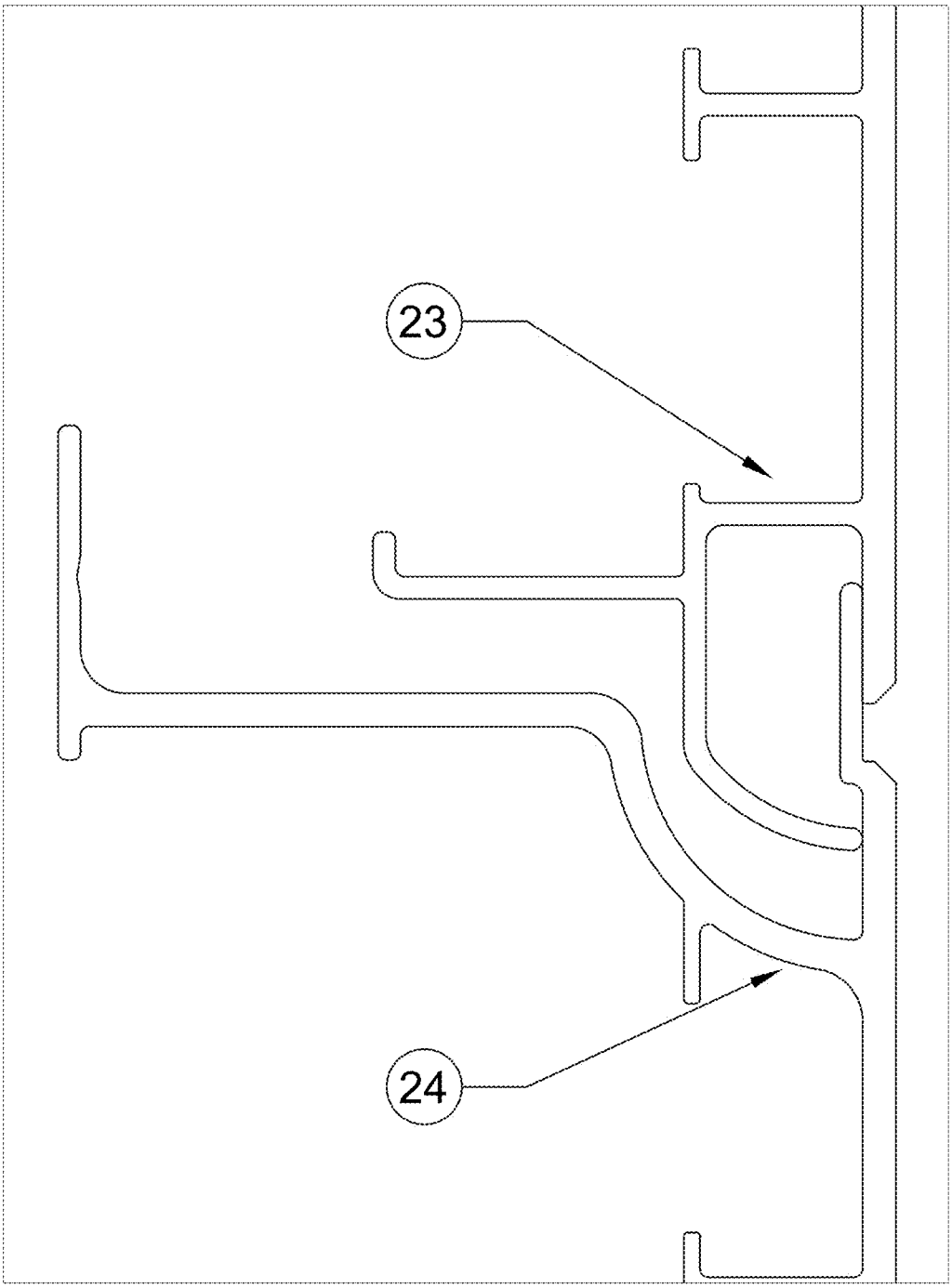
FIG. 2B is an enlarged diagram showing exemplary alternative interlocking profiles and an exterior cladding profile.

In addition, each exterior cladding panel comprises mateable or interlocking profiles 22, 24 that allow adjacent panels to be mounted to and interlocked with one another. In the embodiment illustrated, a lower interlocking profile comprises an interrupted (i.e., partially open), asymmetrical D-shaped profile 22 that mates with and interlocks in an upper open, curved trough 24, as illustrated. FIG. 2B shows an alternative interlocking profile 23 sized and configured for interlocking with curved trough profile 24. While these profiles are useful and may be preferred for use in some embodiments, it will be appreciated that many other types of interlocking profiles may be used without departing from the present invention. Exterior cladding layers 12 may additionally comprise a lower rib extension 26 extending less than the depth of an insulation component in proximity to the lower interlocking profile, an upper extension 28 having a depth corresponding generally to the depth of an insulation component (as described below) and an upstanding rear bar 30 for supporting an adjacent cladding component, as shown.

The exterior cladding panel, in one embodiment, is provided as a unitary component composed of the exterior cladding layer, the interlocking profiles and one or more extending ribs or support members. In alternative embodiments, one or more components may be provided as separate components and assembled, or joined to provide an exterior cladding panel as described and shown herein. A unitary exterior cladding panel may be constructed from a substantially liquid impervious material using various manufacturing techniques that are well known in the art. The material from which the exterior cladding panel is fabricated preferably has one or more of the following properties: substantially liquid impervious; high hydrophobicity; durable finish; UV resistant; substantially chemical resistant; non-corroding; substantially non-decaying; chemically stable; substantially non-wicking; low thermal conductivity; generally light weight; high strength; non-shrinking; generally low coefficient of thermal expansion; generally low sound transmittance.

Preferred exterior façade materials include glass-reinforced plastics (e.g., fiberglass compositions), polymeric and/or thermoplastic materials such as polyurethane, polyester and other materials, generally lightweight metallic materials, and the like. Fiberglass compositions are suitable and may be preferred for many embodiments because they provide a durable finish, and are substantially UV- and chemical-resistant, non-corroding, substantially non-decaying and chemically stable. Glass-reinforced plastics are also generally hydrophobic and non-wicking, and they have low thermal conductivity, a low coefficient of thermal expansion and high strength, as well as beneficial acoustic properties. Glass-reinforced plastic compositions may be manufactured from recycled glass and may additionally offer advantages in manufacturing and favorable environmental benefits. Preferred materials include fiberglass pultruded materials, polyurethane pultrusion materials, polyesters, and the like. Such materials are available, for example, from Inline Fiberglass Ltd., 30 Constellation Court, Toronto, ON, CANADA. Panels and cladding layers of the present invention may be provided with a full range of exterior (and/or interior) coatings, colors and finishes including, without limitation, unlimited color choices, textural finishes such as stucco, wood laminates, smooth finishes, and the like.

FIGS. 1 and 2 also show insulation component 32 mounted behind the exterior cladding layer 12. Insulation component 32 may comprise a variety of insulating materials. Mineral wool-type insulation (e.g., Rockwool) is suitable and mineral wool-type insulation provided in a substantially rigid format is preferred for many applications. Other types of insulation, including substantially rigid insulation, foam insulation, fiberglass insulation, IsoBoard, high density extruded polystyrene rigid insulation, and many other types of rigid and semi-rigid insulation are suitable. Insulation preferably provides high thermal insulation properties and may additionally provide fire resistance, acoustic damping or low acoustic transmittance properties, and the like.

Insulation components 32 may be mounted to or otherwise associated with stops 18 of the façade 12 by any suitable means, such as by adhesive, bonding agents, mechanical fasteners or prongs, or the like. In other embodiments, insulation 32 may be "free floating" and retained in place by central rib 20, lower and/or upper rib extensions 20, or other structural components. Rib 20 may be provided in a generally central location and may extend substantially the depth of insulation 32 to provide support for the insulation. Additional extending ribs may be provided. Insulation may be provided and pre-mounted in pre-assembled exterior façade components, or insulation may be provided separately from the exterior cladding façade structure and mounted in exterior façade components at a construction site during or prior to installation of the façade.

The space between insulation components 32 and the interior surface of exterior cladding surface 14 provides a capillary break or air cavity between the layers, which provides pressure equalization chambers that decelerate and quell inward water intrusion by reducing propellant energy and inertia. The air cavity/capillary space substantially eliminates water bridging and facilitates drying of any water that penetrates the space by drying as a result of convective air flow. The capillary space is fully enclosed from the external environment by a combination of façade structural components and insulation and has no substantial communication with the exterior environment or with the channel formed by the combination of interlocking profiles 22, 24. A capillary space provided between the interior surface of the external façade member and the insulation having a depth of least about 0.1 inches is suitable. Capillary spaces having a depth of about one inch or more may be suitable depending on the relative scale of the cladding panel.

In some embodiments, a substantially liquid impervious and/or heat reflective layer 34 may be positioned on or near the surface of insulation facing the capillary space. Layer 34 is preferably relatively thin, and generally has a thickness less than the depth of the air cavity/capillary space. In one embodiment, layer 34 comprises a foil-faced reflective layer that neutralizes the effects of air temperature and convective cooling. A foil-faced layer can be very effective in reflecting and/or redirecting heat to the interior/exterior of the thermal plane, which improves both heating and/or cooling efficiencies. In alternative embodiments, a similar substantially liquid impervious and/or heat reflective layer may be positioned on or near an interior surface 36 of insulation 32. Many different types substantially liquid impervious and/or heat reflective layers may be employed, including, for example, metallic foils such as aluminum and stainless steel reflective foils, as well as other types of layers and membranes.

The interlocking profiles of the façade panels are slidable with respect to one another and provide a simple, quick and convenient snap-fit assembly of façade panels to one another. While other interlocking profiles may be used, the partially curved profiles provide advantages. Curved trough 24 forming one of the interlocking profiles desirably serves as an integral internal raceway gutter system that captures any liquid that penetrates interlocking façade panels at seams and transports the liquid, captively, to coordinated structural end-caps. The raceway gutter system also desirably acts as a first pressure equalization zone that decelerates and traps water entering an exposed external material seam.

In one exemplary embodiment, the following component dimensions are implemented: façade panels are 16 inches wide (as shown in FIG. 2); insulation 32 is 3.5 inches thick; and the depth of the capillary break between the interior surface of the external cladding wall and the insulation is approx. 1 inch thick. Other dimensions are noted in FIG. 2. While these dimensions are presently preferred for some applications, it will be apparent that façade panels of the present invention having many different dimensions and profiles may be constructed without departing from the principles of the present invention.

Figure 3A:
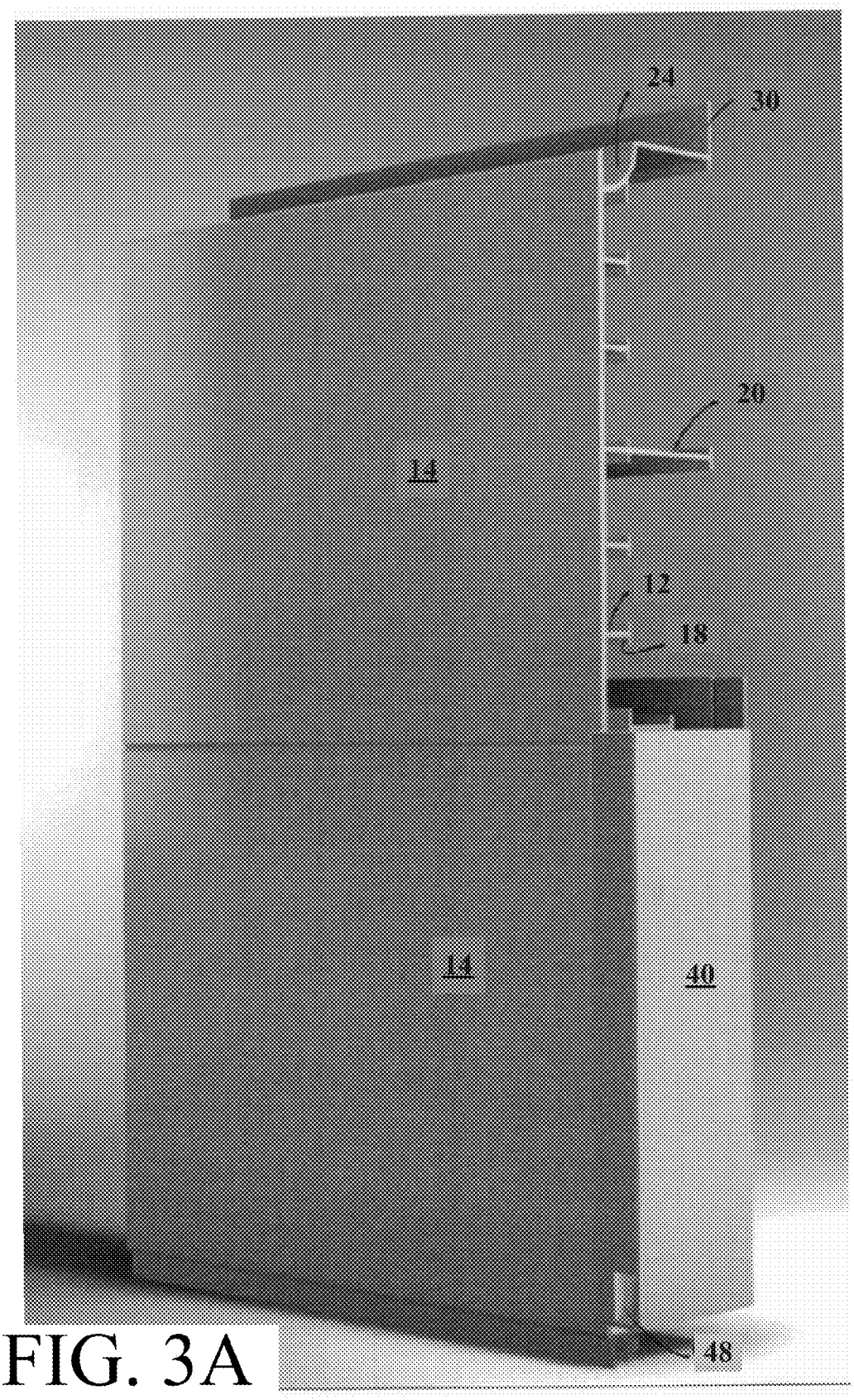
FIG. 3A is a rendering showing an exterior and end perspective view of segments of two exterior cladding façade components as shown in FIGS. 1 and 2A interlocked with one another, with the upper panel shown without insulation component and with an end-cap mounted on the lower panel.
Figure 3B:
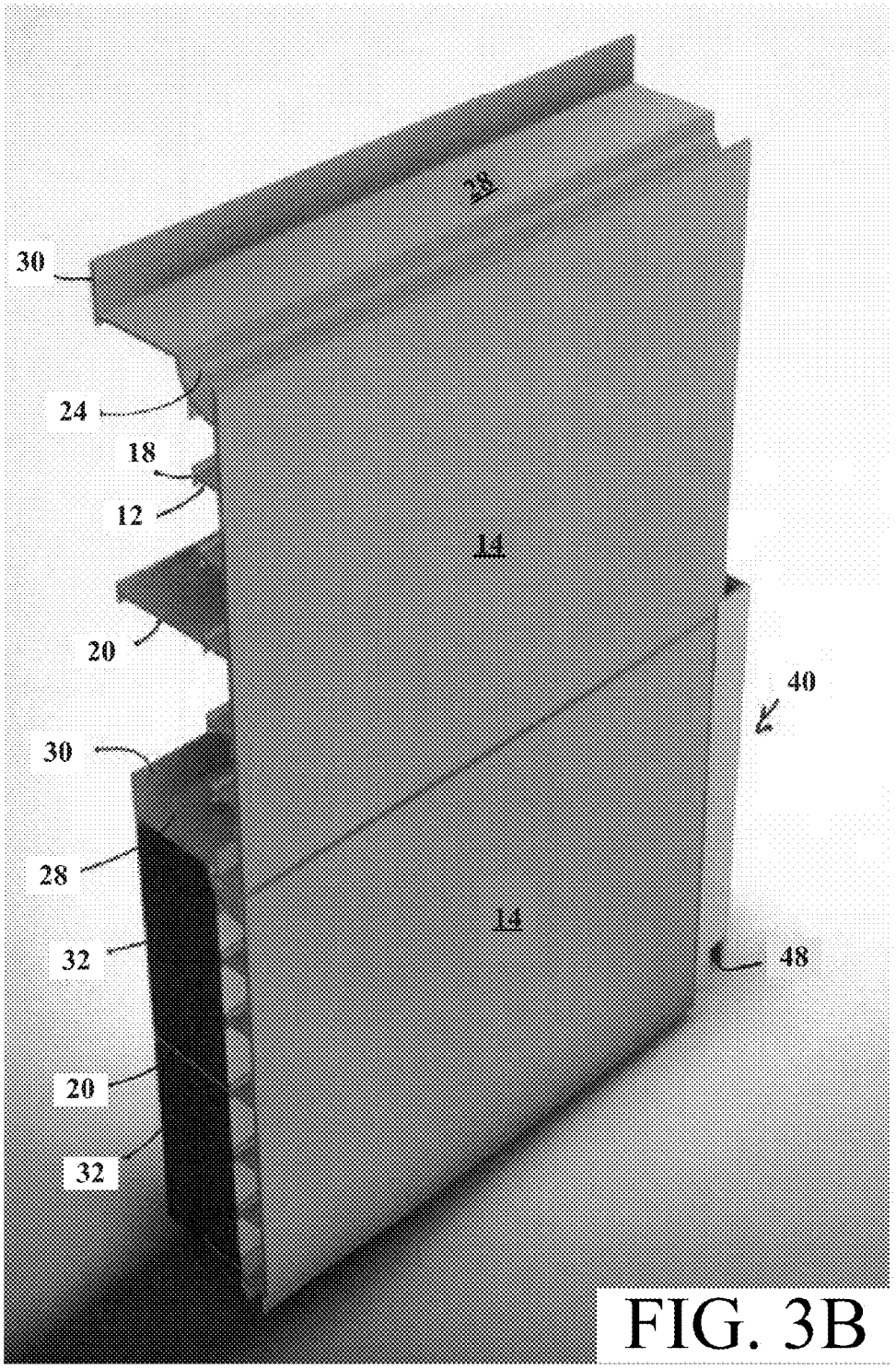
FIG. 3B is a rendering showing a view similar to that of FIG. 3A from an opposite end, illustrating insulation components mounted in the lower panel.
Figure 3C:
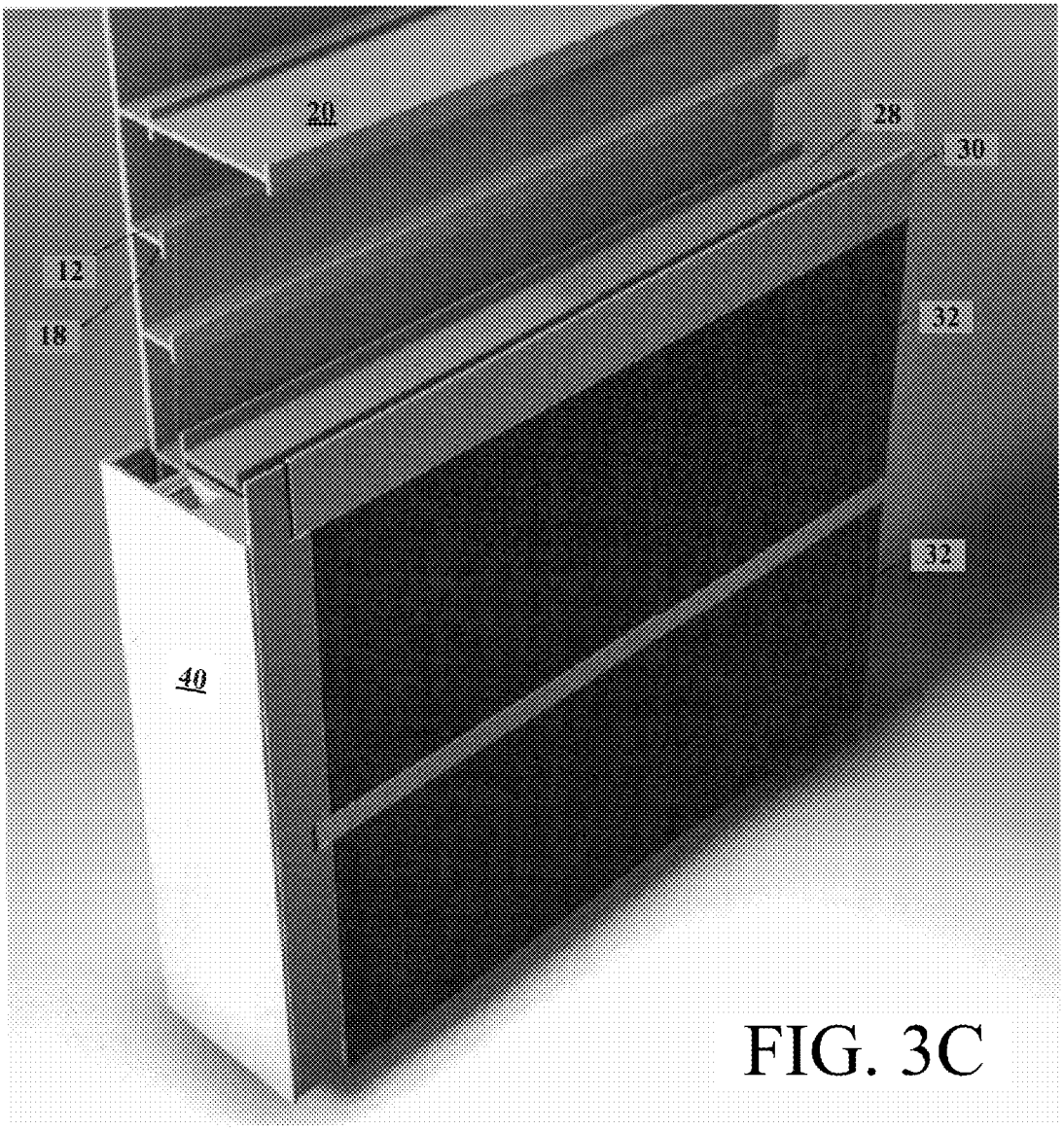
FIG. 3C is a rendering showing an interior and end perspective of two cladding façade components interlocked with one another, with the upper panel shown without insulation component and with an end-cap mounted on the lower panel.
Figure 3D:
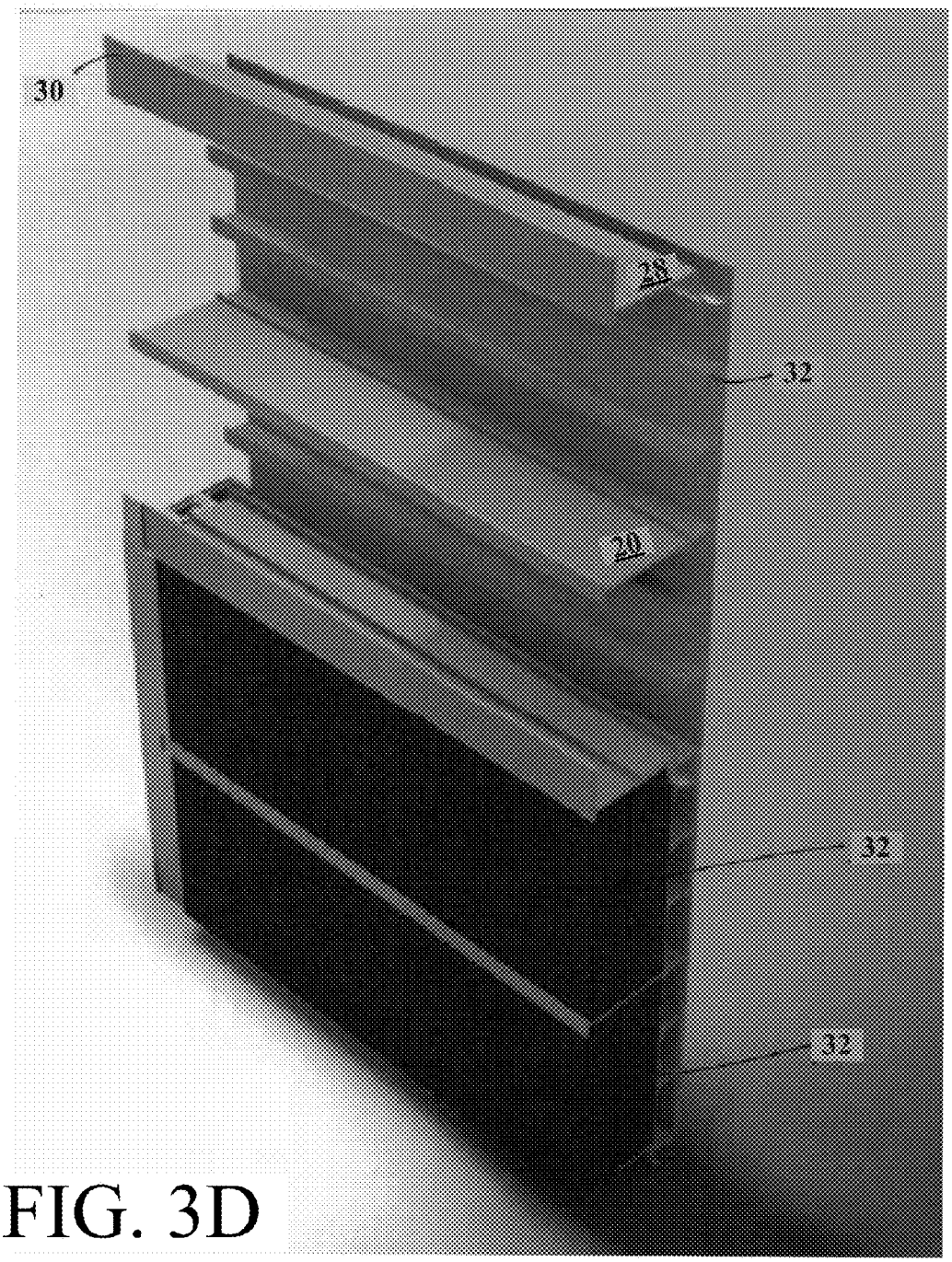
FIG. 3D is a rendering showing a view similar to that shown in FIG. 3C from an opposite end, illustrating insulation components mounted in the lower panel.
Figure 3E:
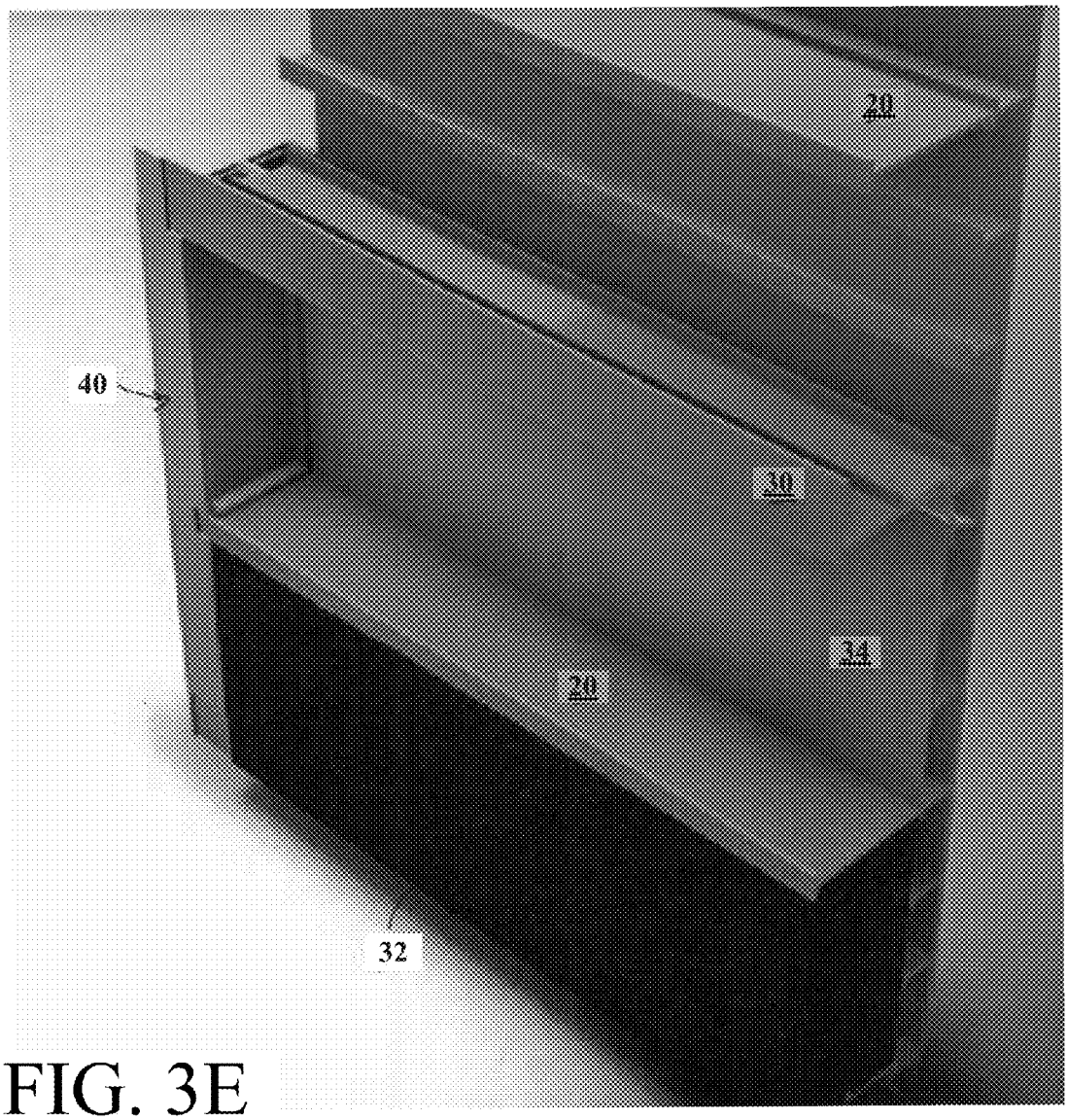
FIG. 3E is a rendering showing an interior perspective of a façade panel of the present invention with one of the insulation panels removed from the lower panel to show the reflective layer positioned between the capillary break and the insulation component.

Renderings of exemplary wall façade components are shown in FIGS. 3A-3E. These figures illustrate the façade structural components as described above, using corresponding reference numerals to show corresponding elements. The insulation component has been removed from the upper façade component to better illustrate the structural façade elements. FIGS. 3A and 3B show exterior perspective views and FIGS. 3C and 3D show interior perspective views of two façade panels interlocked with one another, with an end-panel 40 mounted on the lower façade panel and the insulation components 32 omitted from the upper façade panel for purposes of clarity. The capillary space/air cavity positioned between the interior side of the external cladding surface 14 and insulation components 32 is clearly visible, and the ease of assembly of the constituent components is readily apparent. FIG. 3E illustrates a substantially liquid impervious and/or heat reflective layer 34 positioned on or near the surface of insulation facing the capillary space. A liquid impervious and/or heat reflective surface of layer 34 preferably faces the capillary space/air cavity.

Figure 4A:
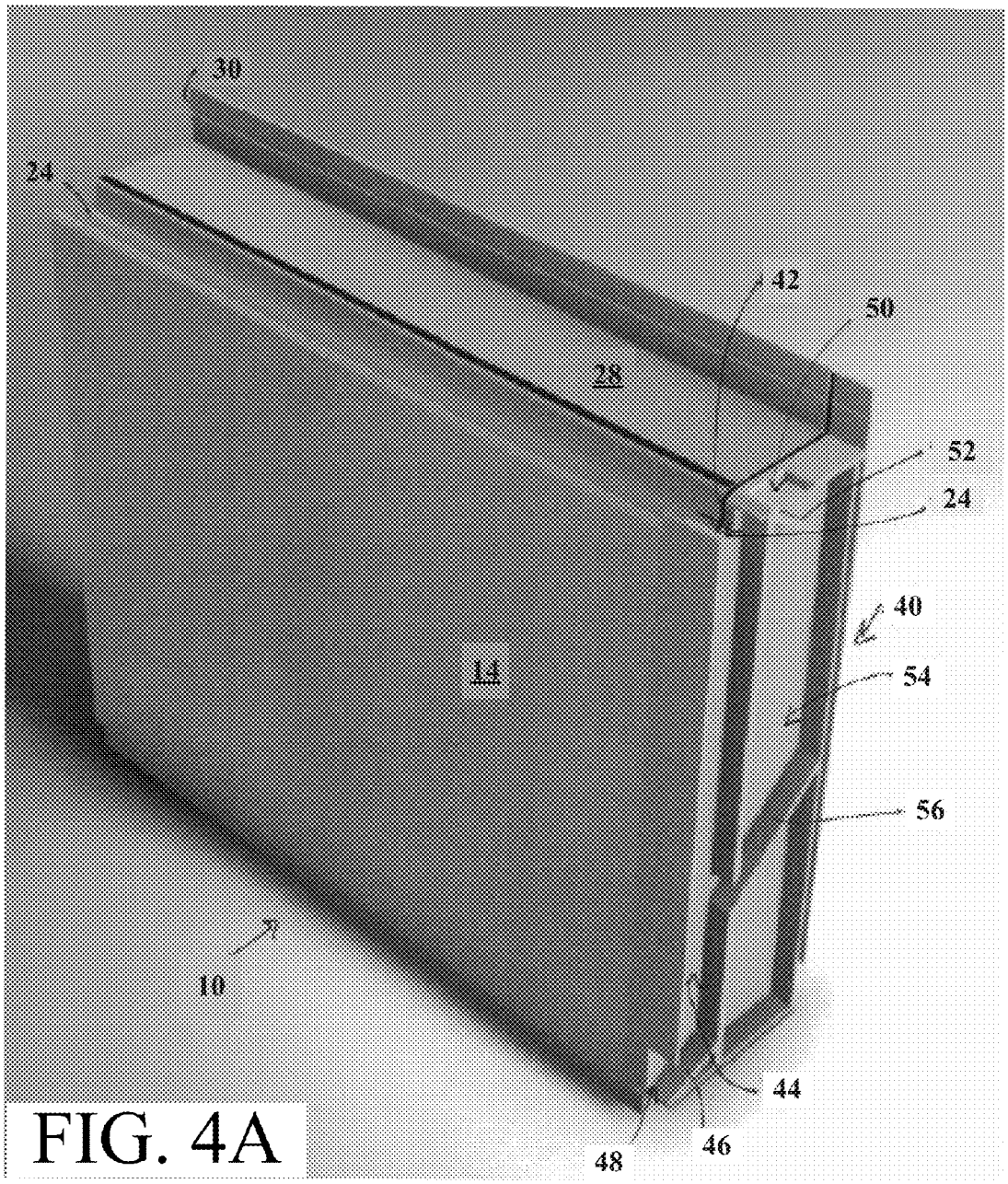
FIGS. 4A-4D show renderings illustrating an exemplary end-cap mountable on the end of a façade panel as shown above.
Figure 4B:
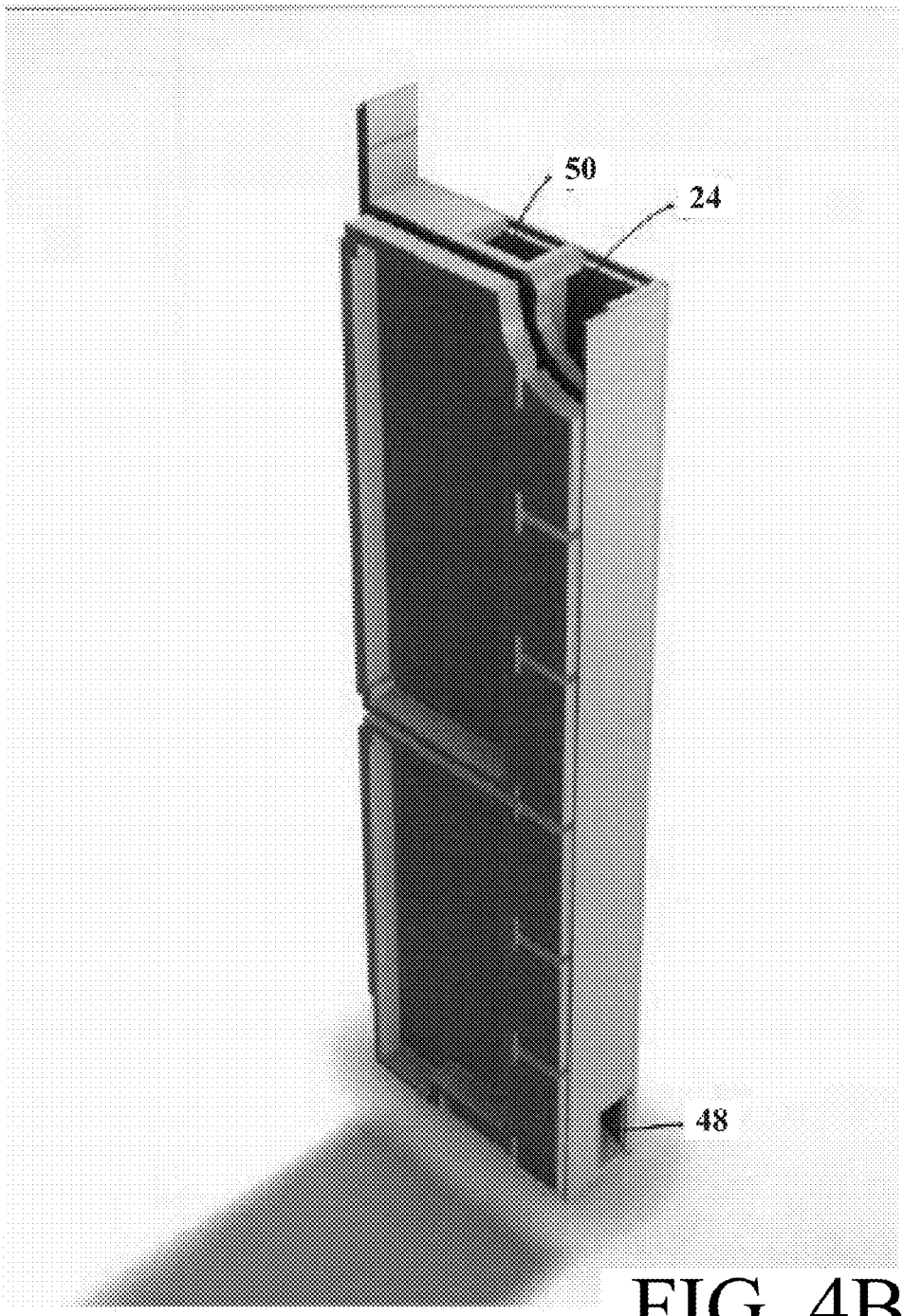
Figure 4C:
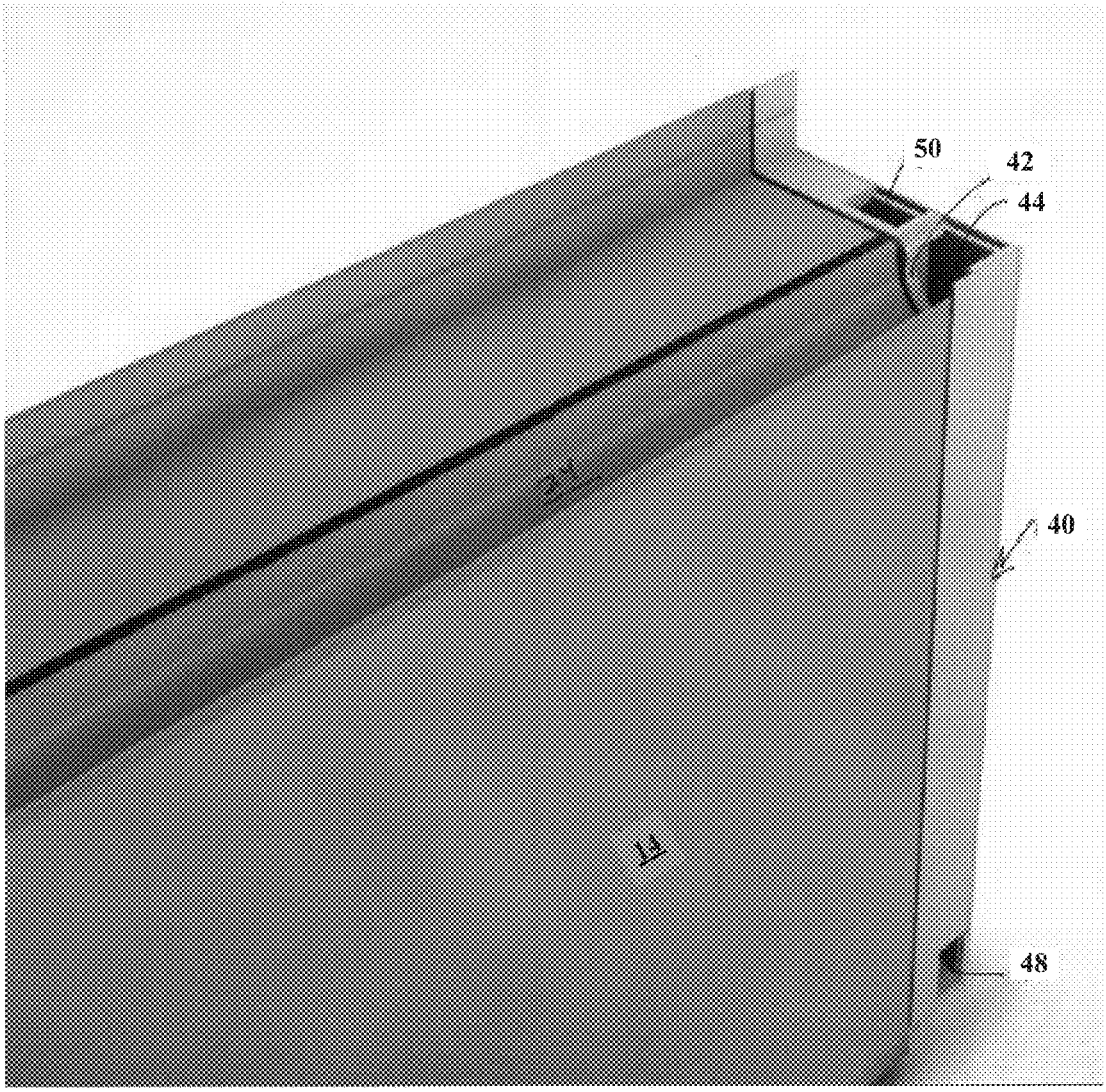

FIGS. 4A-4C show one embodiment of an end-cap member 40 that coordinates with exterior cladding panels 10 of the present invention and serves to enclose and finish end of the cladding panels. In some embodiments, end-cap members coordinate with the profile structure of the cladding panels to divert any liquid that penetrates the seam between adjacent façade panels and is collected in the raceway structure. FIG. 4A illustrates an internal profile of an end-cap 40 having a trough-shaped cut-out 42 at an upper portion that substantially matches and is positioned to mate with the trough-shaped raceway formed by interlocking profile 24 provided at the interface of two façade panels. Any moisture that collects in the raceway formed between interlocked cladding panels transits the raceway and cut-out 42 and enters channel 44. Moisture is then confined in channel 44, falls by gravitational forces and contacts angled diverter 46, which diverts moisture outside the end-cap through exit port 48. Any moisture that enters or collects in seams between façade panels is thus diverted through the end cap structure to the exterior environment.

End-cap 40 may also have an internal profile structure that facilitates diversion of any moisture that collects in the capillary break formed between the exterior cladding structure and the insulation. As shown in FIG. 4A, end-cap 40 may incorporate an upper opening 50 located behind channel 44 that communicates with the capillary break/air cavity and facilitates transfer of moisture that collects in the air cavity into the endcap. Moisture entering at opening 50 contacts (optional) diverter 52 and enters channel 54. Moisture then falls by gravitational forces and is conducted by diverter 56 into channel 44, where it contacts angled diverter 46 and is conducted outside the end-cap through exit port 48. This internal end-cap design thus provides for drainage of any moisture that penetrates seams between façade panels, as well as any moisture that penetrates or collects in the capillary break between the exterior cladding and the insulation. It will be appreciated that while this internal profile configuration works well and provides significant advantages, other profiles, diverter structures, channels, and the like may be used.

Figure 4D:
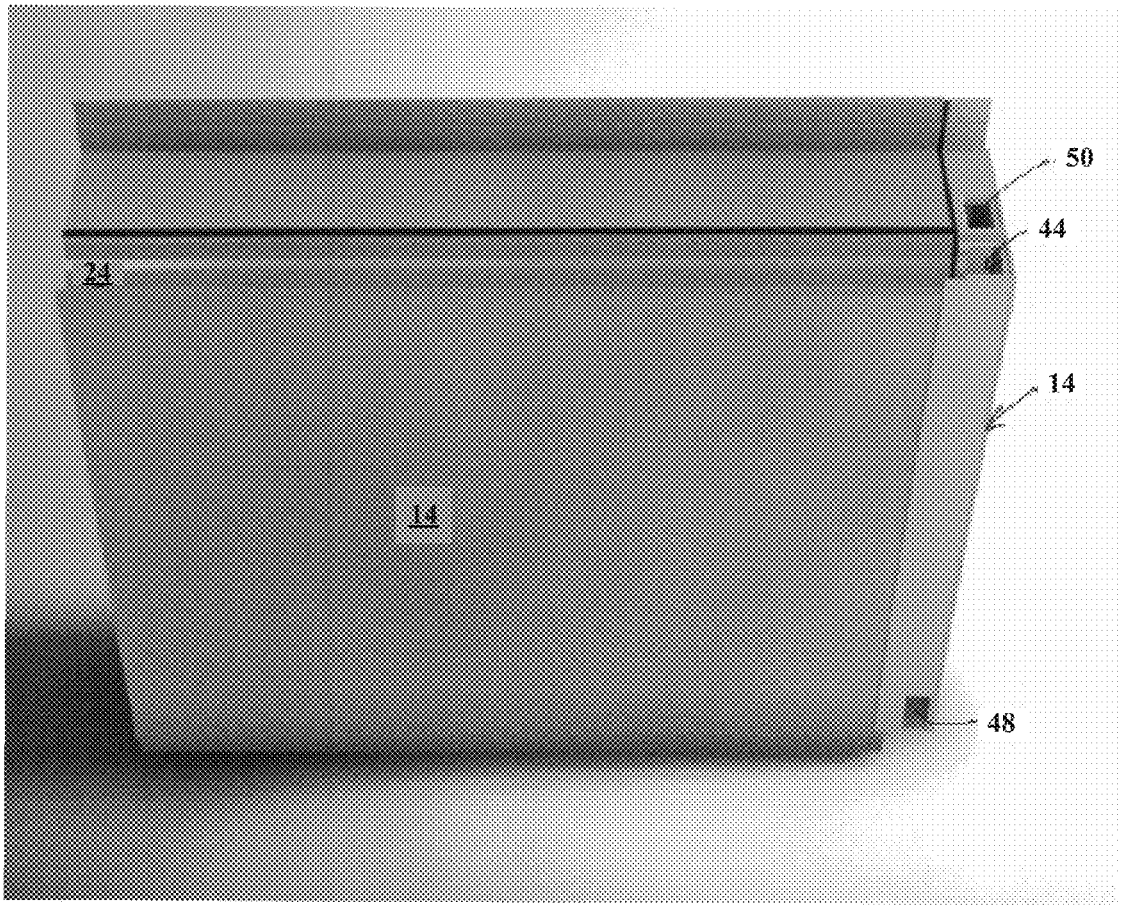

FIG. 4B illustrates an exemplary interior surface configuration for end-cap 40 where it interfaces with and is mounted on a cladding panel; an exemplary exterior surface configuration for end-cap 40 is shown in FIGS. 3A and 3C. The interior surface of the end-cap 40 may be configured to interface with and be mountable on the end of a mating cladding panel using a press-fit, whereby grooves in the end-cap surface are spaced and configured to coordinate with corresponding ribs of the cladding panel structure, and cavities are provided that match the configuration of the insulation. FIGS. 4C and 4D show a front exterior view and a front perspective exterior view of an end-cap 40 mounted to a cladding panel to provide a simple, generally smooth exterior surface and finished exterior surface that provides a port 48 communicating with the exterior environment, an opening 50 communicating with the air cavity of an adjacent cladding panel, and a trough-shaped cut-out 42 communicating with an internal channel 44 for moisture drainage. It will be appreciated that a variety of exterior end-cap surface configurations and appearances may be provided.

Figure 5:
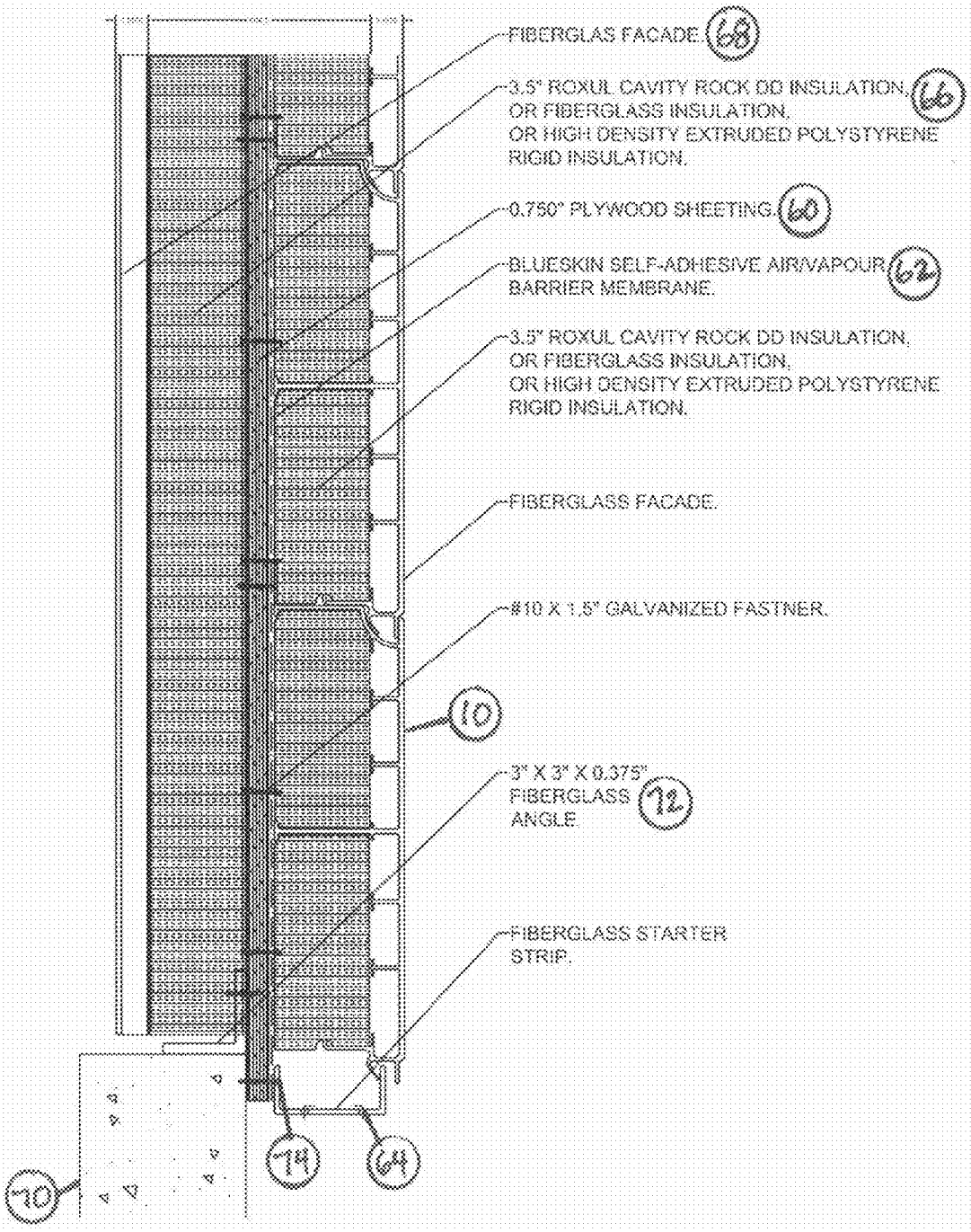
FIG. 5 shows two exemplary façade panels of the present invention mounted to one type of building frame structure, showing additional finish components.

FIG. 5 illustrates a plurality of interlocked façade panels 10 of the present invention mounted to a rigid building structure 60 (such as plywood sheeting). A liquid impermeable liquid and vapor barrier 62 (such as a Tyvek™ or other barrier sheeting or membrane material) is preferably provided between the rigid building structure 60 and the rear face of cladding panels 10, providing a water, vapor and possibly gas barrier between insulation provided as part of the façade panels and a rigid building structure such as plywood. Cladding panels 10 may be mounted on building structure 60 by any suitable means, including fasteners. A simple U-shaped finishing strip 64 may be mounted along the bottom of the lower-most façade panel to provide a finished appearance and to protect the nearby insulation from the elements. Finishing strip 64 may be sized and configured for attachment of one leg to the rigid building structure and attachment of an opposite leg to, or mating of an opposite leg within the panel interface profile structure, as shown. Finishing strip 64 is preferably fabricated from a generally rigid, lightweight material such as a plastic, glass-reinforced plastic or metallic material, and may be solid or perforated to provide ventilation.

FIG. 5 thus illustrates how façade panels 10 of the present invention are attachable to a framed structure having an unfinished exterior to provide an exterior cladding assembly. FIG. 5 also illustrates how larger structural panels may be assembled, and pre-assembled, using cladding panels as described herein. In one embodiment, as shown in FIG. 5, a structural panel may comprise a plurality of façade panels 10 mounted to a rigid building structure such as plywood 60 on an exterior side, with an air and/or vapor barrier 62 provided between the façade panels and the building structure. Additional insulation 66 may be provided between the building structure (plywood) 60 and an interior surface material 68, which may be a finished or finishable interior surface, or an intermediate interior surface suitable for supporting another interior surface finish layer. Panels having this construction may be pre-assembled and shipped to a construction site. Pre-assembled panels having this construction may be mounted to an existing foundation or other type of support structure 70 using a simple bracket 72 (such as a fiberglass angle) and fastener 74 to mount the intermediate rigid building material layer 60 to the foundation 70.

In another embodiment, one edge of a weather resistive barrier such as an air and/or vapor barrier layer or membrane may be attached to an underlying building structure (e.g., plywood) along a portion of its surface area and, along one edge, lapped over support leg 30 of a cladding panel. This technique allows any moisture that collects at the plane of the sheathing (e.g., water migrating downward across the weather resistive barrier) to be directed to the upper extension 28, and from there deposited in the raceway and evacuated laterally to an end-cap and diverted to the exterior side of the cladding panel(s). This embodiment and installation technique provides a fully capable wet drainage wall cladding assembly that incorporates redundancy, allowing water that reaches the weather resistive barrier to be evacuated to the exterior environment through the integral raceway and end-cap structure.

Figure 6A:
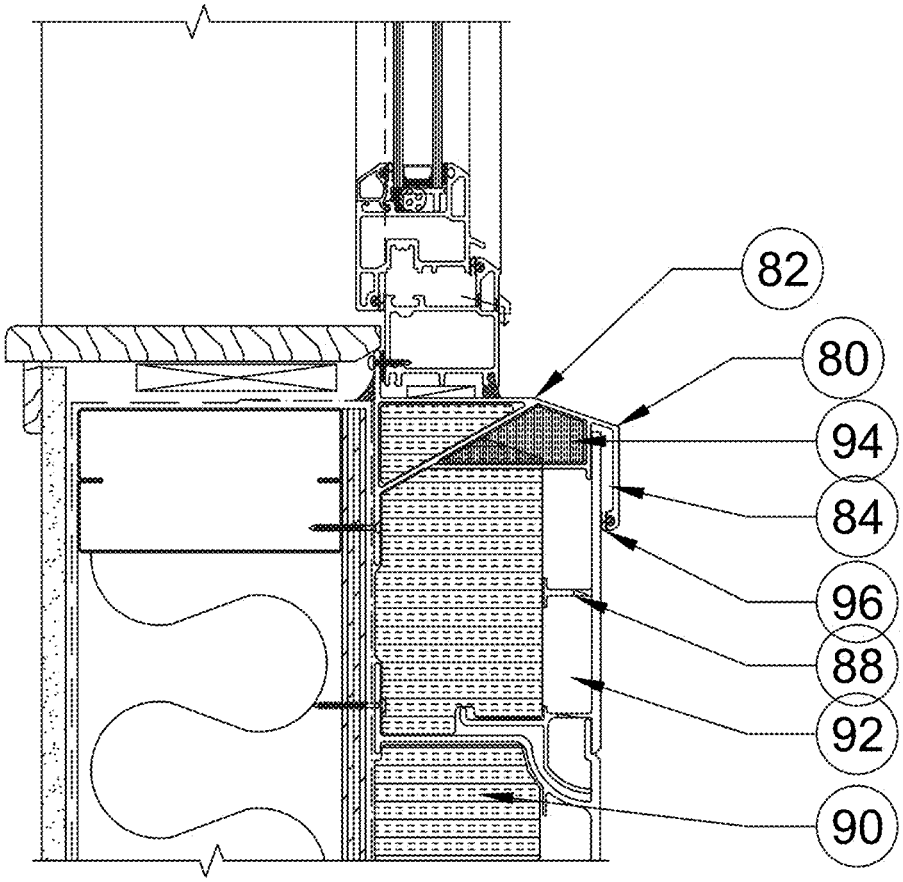
FIG. 6A shows a drawing of a specialized façade sill detail suitable for use with façade panels and wall façade assemblies of the present invention.
Figure 6B:
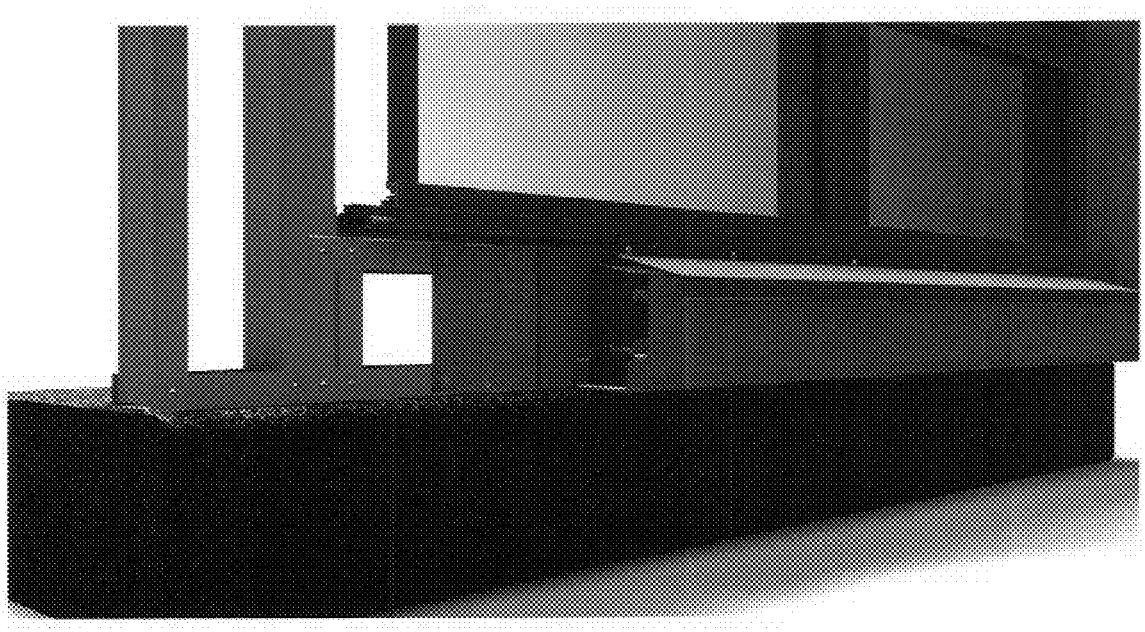
FIG. 6B shows a rendering of a façade sill of the present invention with a cross-section exposed to show the internal structure of the façade sill in place underneath a window.

FIGS. 6A-7B show specialized façade sills, façade heads and façade jambs suitable for use with façade panels and wall façade assemblies of the present invention. FIG. 6A shows an exemplary façade sill 80 having an inclined upper ledge 82 and extending lip 84 constructed from a liquid impervious material mounted over a truncated façade panel having an exterior cladding member 86 with at least one internally extending rib 88 providing separation from insulation 90 and defining a capillary break/air cavity 92. Extending lip 84 defines a cavity 94 having an external opening 96 that allows any moisture the collects in cavity 84 to exit to the exterior. FIG. 6B shows a rendering of a façade sill of the present invention with a cross-section exposed to show the internal structure of the façade sill in place underneath a window.

Figure 7A:
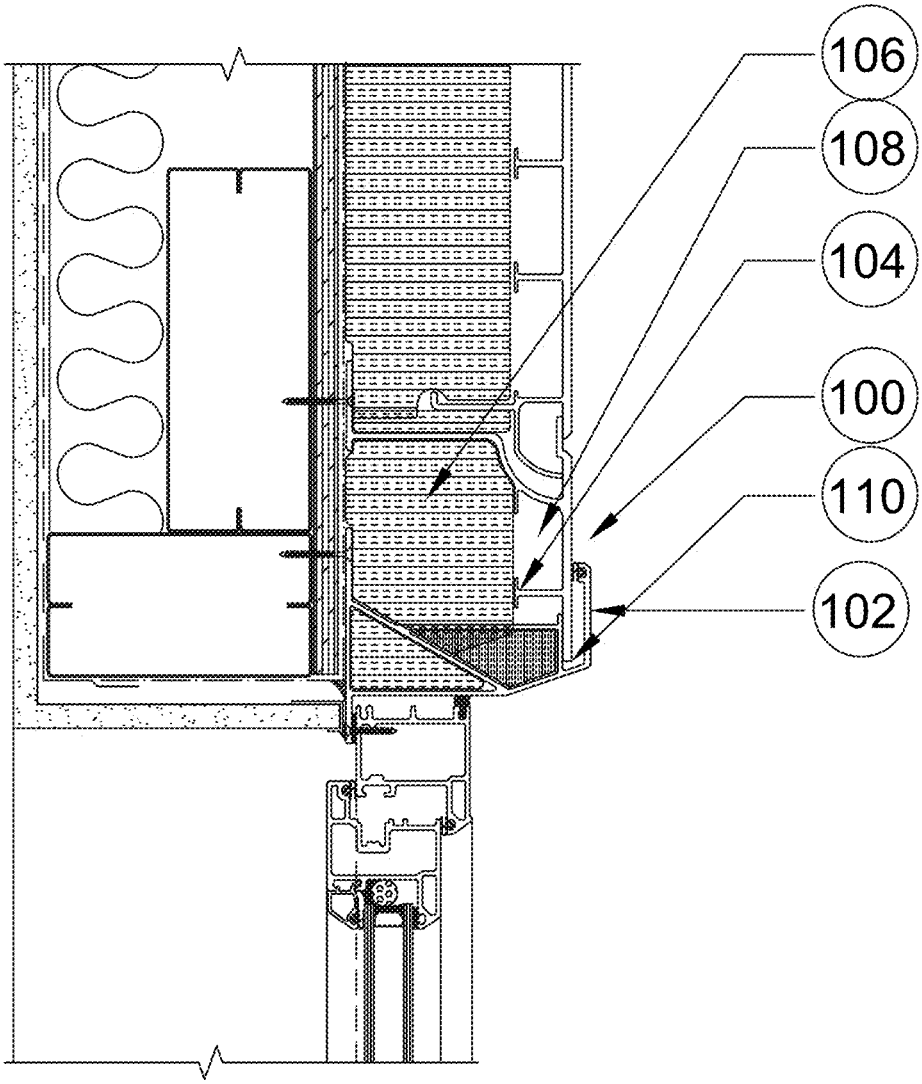
FIG. 7A shows a drawing of a specialized façade head detail suitable for use with façade panels and wall façade assemblies of the present invention.
Figure 7B:
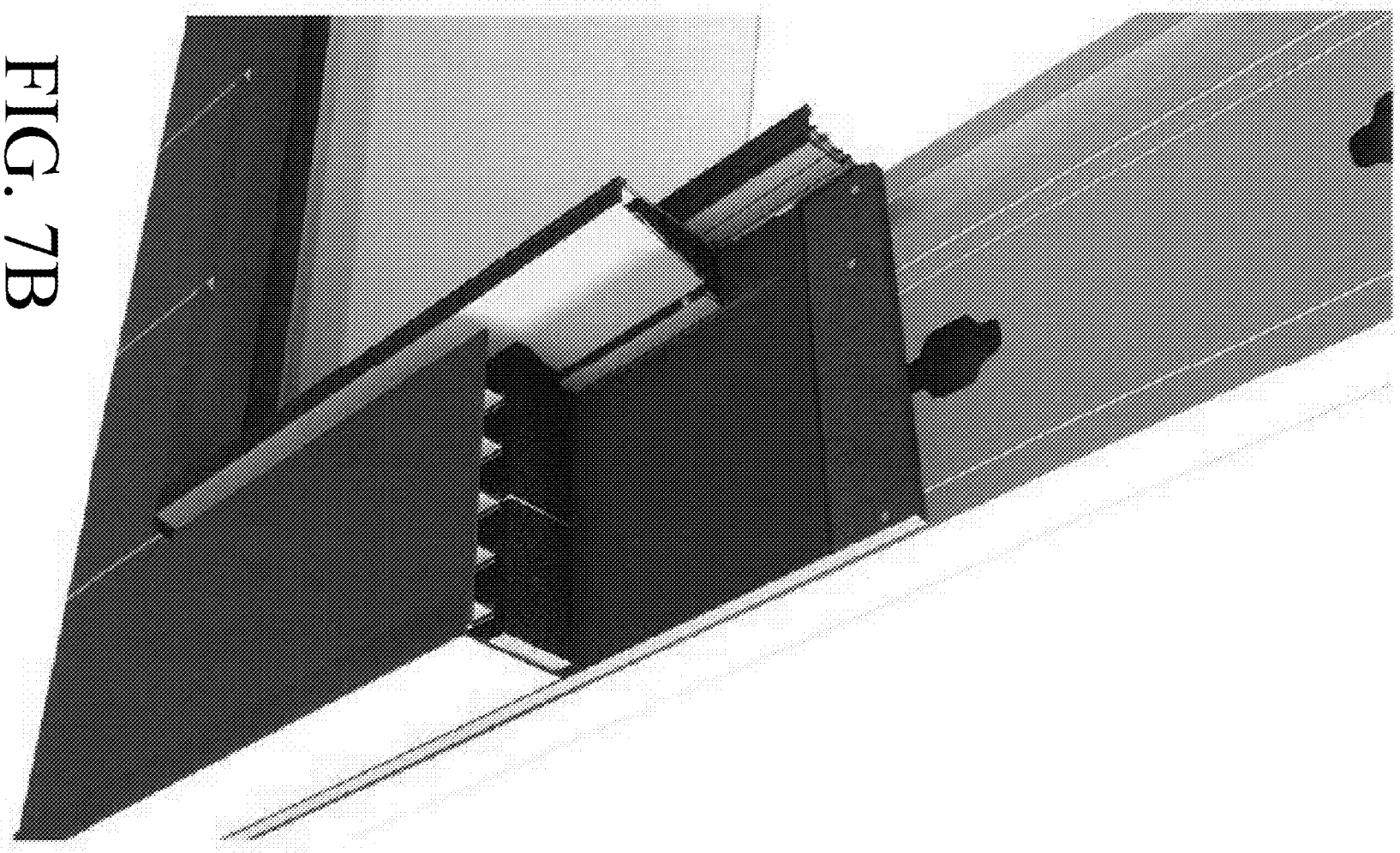
FIG. 7B shows a rendering of a façade head and adjacent façade panel of the present invention with cross-sections exposed to show the internal structure of the façade panel and head.

FIG. 7A shows an exemplary façade head 100 having an inclined ledge 102 constructed from a liquid impervious material and forming a base structure that interfaces with a truncated façade panel having an exterior cladding member 104 and insulation 106 with a capillary break/air cavity 108 provided between the exterior cladding member and insulation. Capillary break/air cavity 108 is in communication with a passageway 110 that allows any moisture trapped in the capillary break/air cavity to drain to the exterior along inclined ledge 102. FIG. 7B shows a rendering of a façade head and adjacent façade panel of the present invention with cross-sections exposed to show the internal structure of the façade panel and head.

FIGS. 8A-8D illustrate an alternative exterior cladding panel 120 of the present invention composed of an exterior cladding layer 122 having an external surface 124 and a plurality of backwardly extending brackets 126. In the illustrated embodiment, brackets 126 are mounted or affixed to (by adhesive or another bonding agent, for example) or formed integrally with exterior cladding layer 122. An interior facing surface of brackets 126 is mounted to or interlocked with or otherwise associated with spacer clips 128 that are in turn mounted in or otherwise associated with insulation component 130. This structure provides an air cavity/capillary break between the interior surface of the exterior cladding layer 122 and insulation component 130.

Figure 8A:
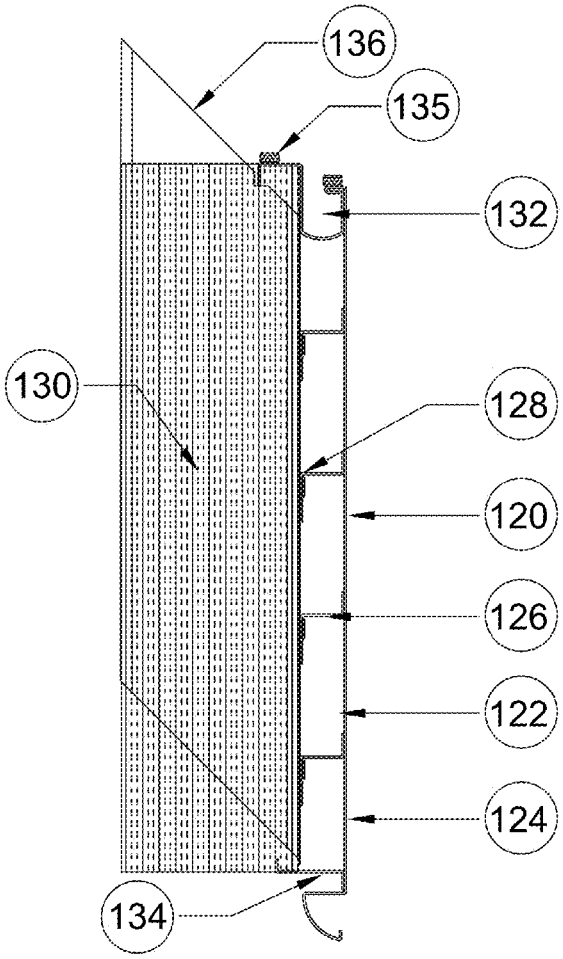
FIGS. 8A-8D show an alternative exterior cladding façade panel of the present invention.
Figure 8B:
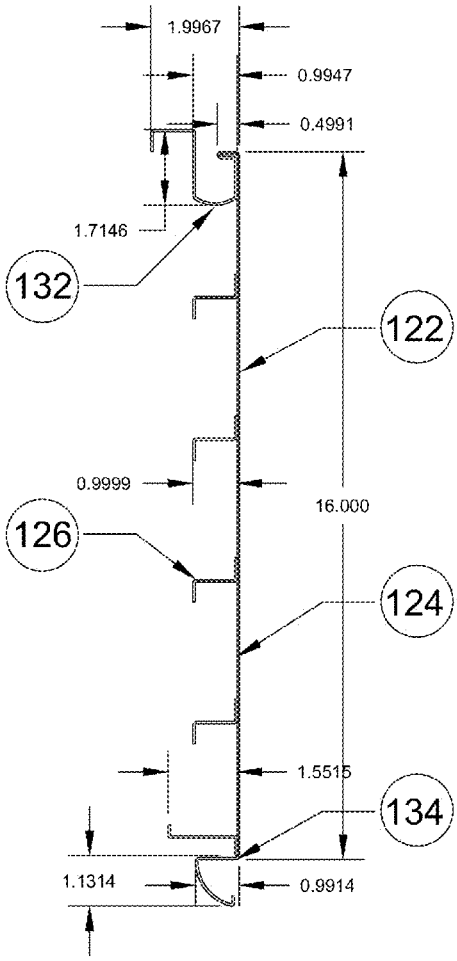
Figure 8C:
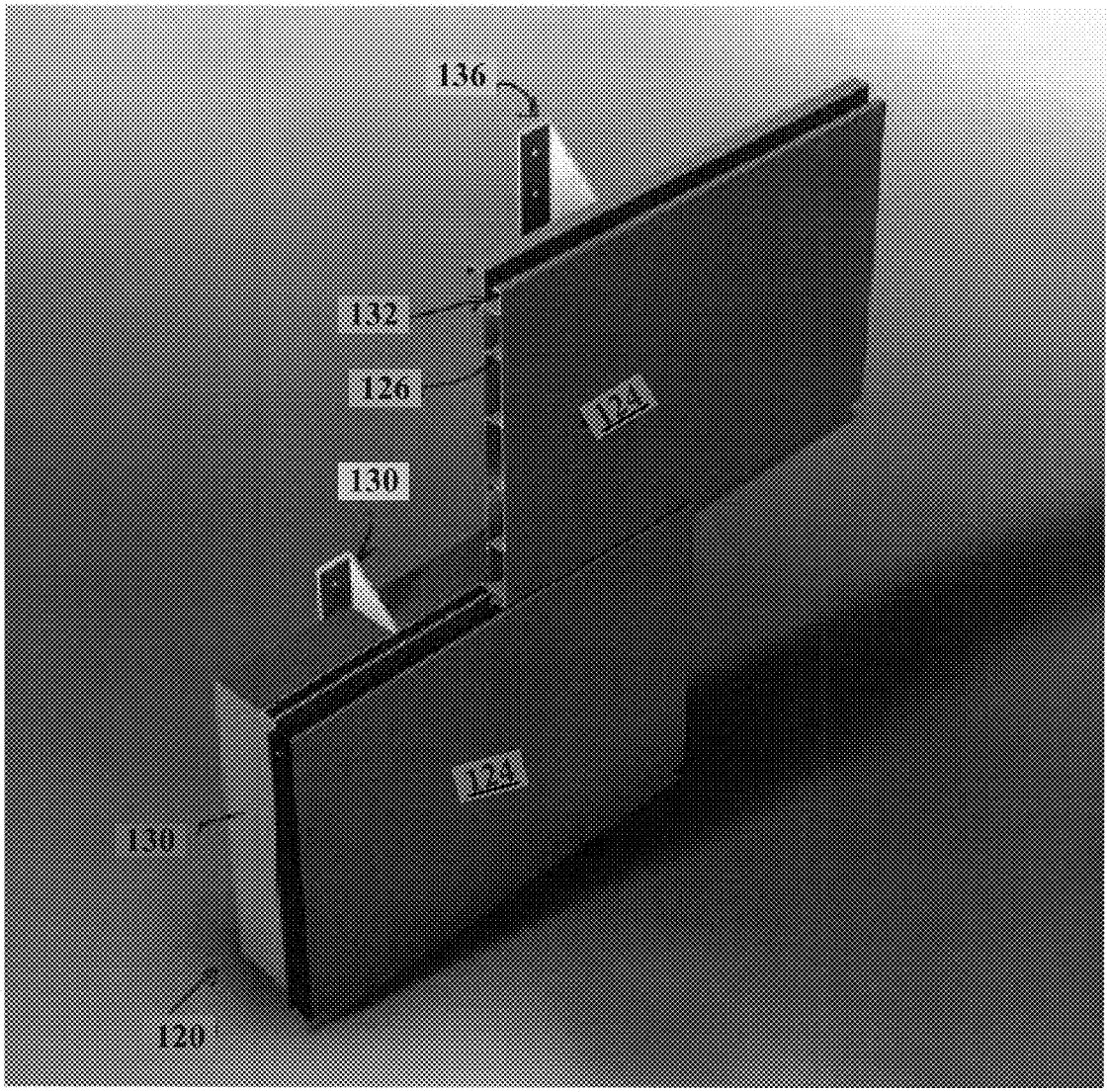
Figure 8D:
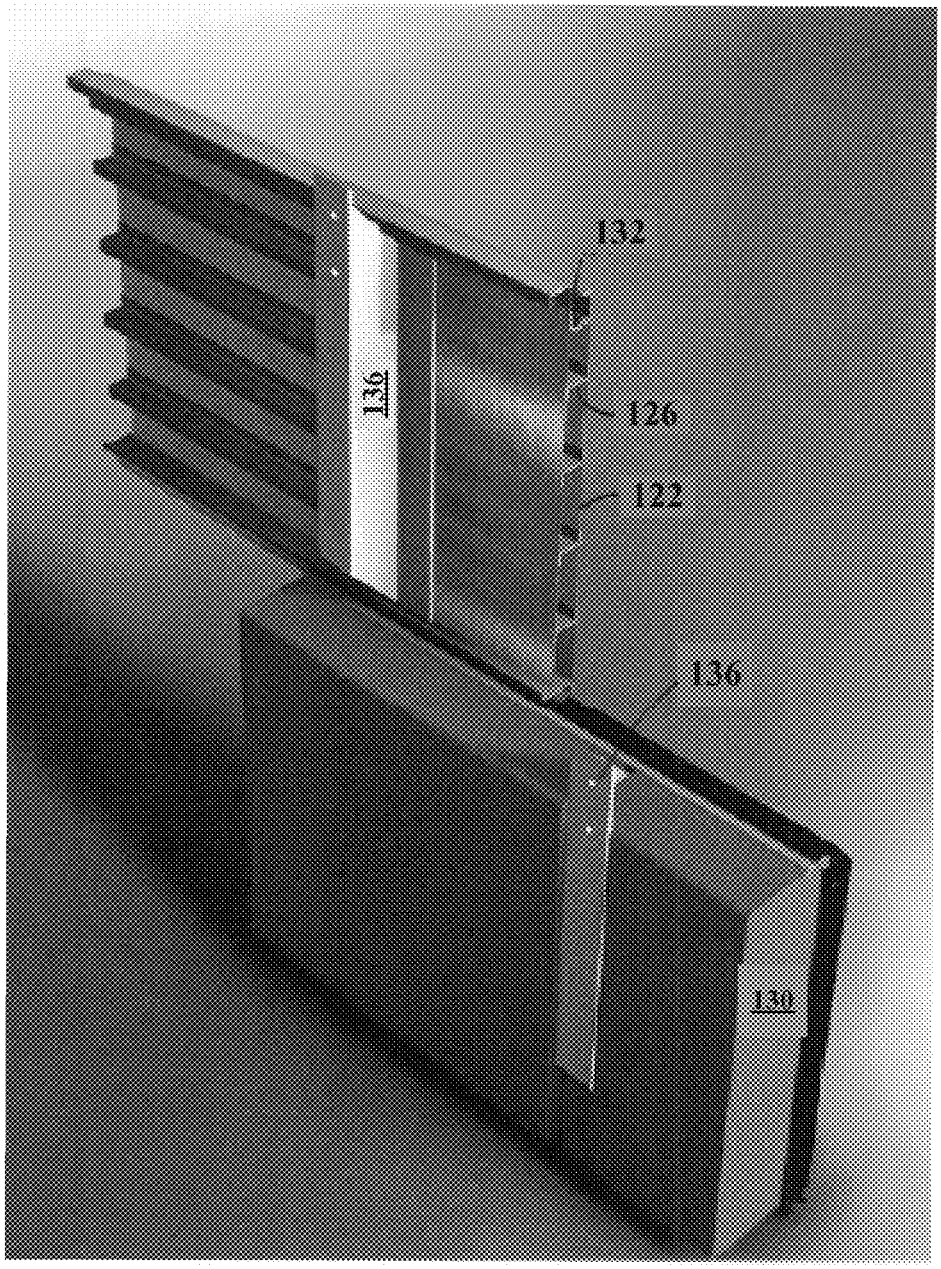

In addition, each exterior cladding panel 120 comprises mate-able or interlocking profiles 132, 134, allowing adjacent panels to be mounted to and interlocked with one another. In the embodiment illustrated, a lower interlocking profile 134 comprises a protruding partially open curved profile that mates with and interlocks in an upper open, partially curved trough 134. While these profiles are useful and may be preferred for use in some embodiments, it will be appreciated that many other types of interlocking profiles may be used without departing from the present invention. Gaskets or spacers 135 may be provided on one or both of the exterior and interior surfaces where the interlocking profiles interface, as shown in FIG. 8A. In one embodiment, gaskets 135 may be provided as silicon gaskets.

A substantially liquid impervious and/or heat reflective layer, as previously described, may be positioned on or near the surface of insulation component 130 facing the capillary space. This liquid impervious and/or heat reflective layer generally has a thickness less than the depth of the air cavity/capillary space and may comprise a metallic foil or foil faced layer that neutralizes the effects of air temperature and convective cooling. Exterior cladding panels 120 may additionally comprise, or be used in conjunction with, an interior facing hanging bracket 136, as shown in FIGS. 8A-8D. The interior facing hanging bracket, in this embodiment, penetrates the insulation component 130 and extends above (or below) the insulation component, providing a rigid structure for mounting the exterior façade panel to an underlying structural building component.

Preferred exterior façade materials for cladding panels include the materials previously described. In one embodiment, exterior cladding layer preferably comprises a metallic sheet material, such as a powder-coated metal material. Spacers may be fabricated from a galvanized metallic material, and the insulation component may be as previously described. Hanging bracket 136 may be fabricated from a metallic material or in some embodiments hanging bracket 136 may be fabricated from a non-metallic material such as a glass-reinforced plastic material (e.g., fiberglass). It will be appreciated that façade panels as shown in FIGS. 8A-8D may be assembled and installed as described previously, and may be pre-assembled to provide larger pre-assembled insulated panels.

Cladding and panels of the present invention substantially eliminate the interior-side cavity contained in the majority of conventional rainscreen assemblies and relocate it to the exterior side of the cladding (and insulation) plane, which improves thermal efficiency and reduces thermal bridging. In preferred embodiments, the pressure barrier is adjacent (e.g., directly adjacent) to the thermal barrier, and the capillary cavity is located on the exterior side of the panel. In preferred embodiments incorporating a reflective material (e.g., foil or a foil-like material) separating the insulation and the capillary break, increased heating and/or cooling efficiency may be provided by reflecting and/or redirecting heat to the interior/exterior of the thermal plane. Also in preferred embodiment, the panels slide and snap together through integral semi-circular interlocking panel channels. This provides for simple, speedy installation, improving construction efficiency. The interlocking panel channels also create a two-stage equalization plane behind the exterior face of the cladding. Moisture that enters a horizontal seam of the cladding is captured in the raceway, which is pressure equalized/neutralized, providing a net zero energy plant (front and back of cladding shell) containing substantially no inertia, drive or propellant energy to transport water inwardly.

In addition, the panel end-caps collect water and redirect it vertically downwards to integral kickout diverters, which evacuate water back to the exterior side of the system. Panels interface with the end-caps to provide structural support and facilitate compartmentalization, which allows the panel system to pressure equalize across the exterior façade and wall system in independent sections, compartments, regions and/or segments.

Individual panels may be provided in a variety of dimensions. In some installations, the top portion of each panel is fastened in to substrate; the bottom portion of the panel is interlocked with the continuous channel of the panel below. In one installation scenario, a starter strip channel is installed at the base of a wall and each successive panel is installed, working from the bottom up. A finish cap may be provided at the top portion of the installation. In some applications, the panels may be used in vertical rather than horizontal orientations.

It will be appreciated that the methods and systems of the present invention may be embodied in a variety of different forms, and that the specific embodiments shown in the figures and described herein are presented with the understanding that the present disclosure is considered exemplary of the principles of the invention, and is not intended to limit the invention to the illustrations and description provided herein.

We claim:

1. A panel comprising: a cladding facade component having a substantially continuous outer surface and a plurality of ribs extending from an inner surface for a distance and terminating a distance from the inner surface; at least a first profile comprising a trough-shaped configuration extending along a length of the panel and away from the inner surface at a first location and at least a second profile, different from the first profile, having a partially open, asymmetrical D-shaped configuration extending away from the inner surface at a second location, whereby the first and second profiles are formed as integral extensions from the inner surface of the cladding façade component, whereby the first and second profiles have mating configurations that allow adjacent panels to be interlocked with one another, and whereby the first and second profiles, when interlocked, form a continuous, trough-shaped raceway.

2. The panel of claim 1, wherein the ribs are integral with the inner surface.

3. The panel of claim 1, wherein when multiple cladding facade components are assembled in a side-by-side fashion, the trough-shaped configuration of the first profiles provides as continuous raceway.

4. The panel of claim 1, additionally comprising an insulation component having a first surface positioned a distance from the inner surface and extending for a depth away from the inner surface.

5. The panel of claim 4, additionally comprising a substantially heat reflective layer positioned between the inner surface and the first surface of the insulation component.

6. The panel of claim 1, fabricated from a glass-reinforced plastic material.

7. A preassembled wall facade assembly comprising a plurality of panels of claim 1 mounted to a rigid structural support, wherein the rigid structural support is positioned interiorly of the plurality of panels.

8. A preassembled wall facade assembly of claim 7, additionally comprising a vapor barrier provided between the panels and the rigid structural support.

9. A preassembled wall facade assembly of claim 7, additionally comprising insulation positioned near and interiorly of an interior surface of the rigid structural support.

10. A preassembled wall facade assembly of claim 9, additionally comprising a finished or finishable surface provided near and interiorly of the insulation.

11. A panel comprising: a cladding facade component having a substantially continuous outer surface; a plurality of ribs extending from an inner surface of the cladding façade component for a distance and terminating a distance from the inner surface; at least one rib projecting a greater distance from the inner surface than the plurality of ribs; and a lower interlocking profile and an upper interlocking profile, the lower and upper interlocking profiles being formed as integral extensions from the inner surface of the cladding façade component that allow adjacent panels to be interlocked with one another and that, when interlocked, form a continuous raceway configured to capture moisture behind the outer surface.

12. The panel of claim 11, wherein at least one of the interlocking profiles has a generally trough-shaped configuration that, when multiple panels are assembled in a side-by-side fashion, provides a continuous trough-shaped raceway between panels.

13. The panel of claim 11, fabricated from a glass-reinforced lactic material.

14. An assembly comprising a plurality of interlocking panels of claim 11.

15. The assembly of claim 14, additionally comprising one or more insulation components having a first surface positioned a distance from the inner surface and extending for a depth away from the inner surface.

16. The assembly of claim 14, additionally comprising at least one extending rib projecting a distance from the inner surface sufficient to support one or more insulation component(s).

17. The assembly of claim 14, additional comprising at least one end cap having a profile that coordinates with the first and second profiles of the cladding façade component and an internal drainage channel.

18. The panel of claim 4, additionally comprising a substantially liquid impervious layer positioned between the inner surface and the first surface of the insulation component.

* * * * *